US009019197B2

(12) United States Patent
Lin

(10) Patent No.: US 9,019,197 B2
(45) Date of Patent: Apr. 28, 2015

(54) DRIVING SYSTEM FOR ELECTROPHORETIC DISPLAYS

(75) Inventor: Craig Lin, San Jose, CA (US)

(73) Assignee: E Ink California, LLC, Fremont, CA (US)

( * ) Notice: Subject to any disclaimer, the term of this patent is extended or adjusted under 35 U.S.C. 154(b) by 122 days.

(21) Appl. No.: 13/556,900

(22) Filed: Jul. 24, 2012

(65) Prior Publication Data

US 2013/0063497 A1 Mar. 14, 2013

Related U.S. Application Data

(60) Provisional application No. 61/533,562, filed on Sep. 12, 2011.

(51) Int. Cl.
*G09G 3/34* (2006.01)

(52) U.S. Cl.
CPC ..... *G09G 3/344* (2013.01); *G09G 2340/16* (2013.01)

(58) Field of Classification Search
None
See application file for complete search history.

(56) References Cited

U.S. PATENT DOCUMENTS 7,859,742 B1 12/2010 Chiu et al.
8,558,786 B2 10/2013 Lin
2006/0232531 A1* 10/2006 Amundson et al. ..... 345/87
2007/0057906 A1 3/2007 Johnson et al.
2009/0195568 A1 8/2009 Sjodin
2009/0256868 A1 10/2009 Low et al.
2011/0175945 A1* 7/2011 Lin ..... 345/690
2011/0254820 A1* 10/2011 Lu et al. ..... 345/211
2012/0050349 A1* 3/2012 Yamada et al. ..... 345/690
2012/0169676 A1 7/2012 Peng et al.

FOREIGN PATENT DOCUMENTS

CN 101567168 A 10/2009
CN 101986380 A 3/2011

OTHER PUBLICATIONS

Kao, W.C., Ye, J.A., Chu, M.I. and Su, C.Y. (Feb. 2009) Image Quality Improvement for Electrophoretic Displays by Combining Contrast Enhancement and Halftoning Techniques. *IEEE Transactions on Consumer Electronics*, 2009, vol. 55, Issue 1, pp. 15-19.

Kao, W.C., Ye, J.A. and Lin, C. (Jan. 2009) Image Quality Improvement for Electrophoretic Displays by Combining Contrast Enhancement and Halftoning Techniques. *ICCE 2009 Digest of Technical Papers*, 11.2-2.

* cited by examiner

*Primary Examiner* — Adam R Giesy
(74) *Attorney, Agent, or Firm* — Perkins Coie LLP

(57) ABSTRACT

This application is directed to a driving system for an electrophoretic display. The driving system can reduce the memory space required for driving an electrophoretic display.

5 Claims, 8 Drawing Sheets

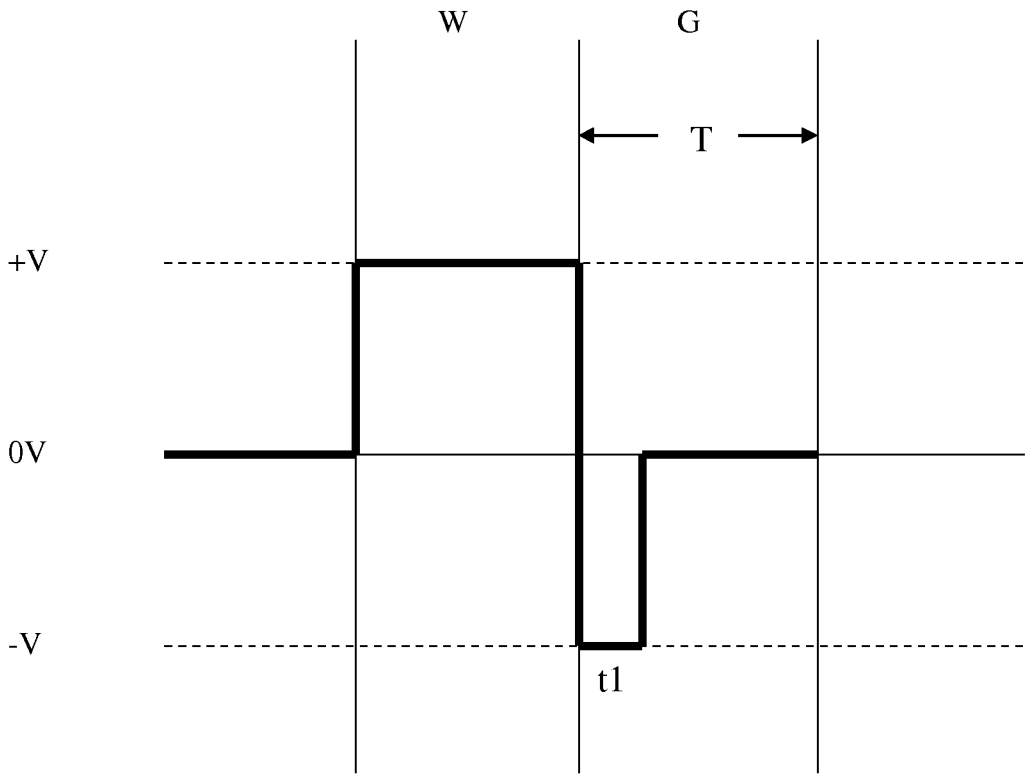
Figure 7a: WG Waveform

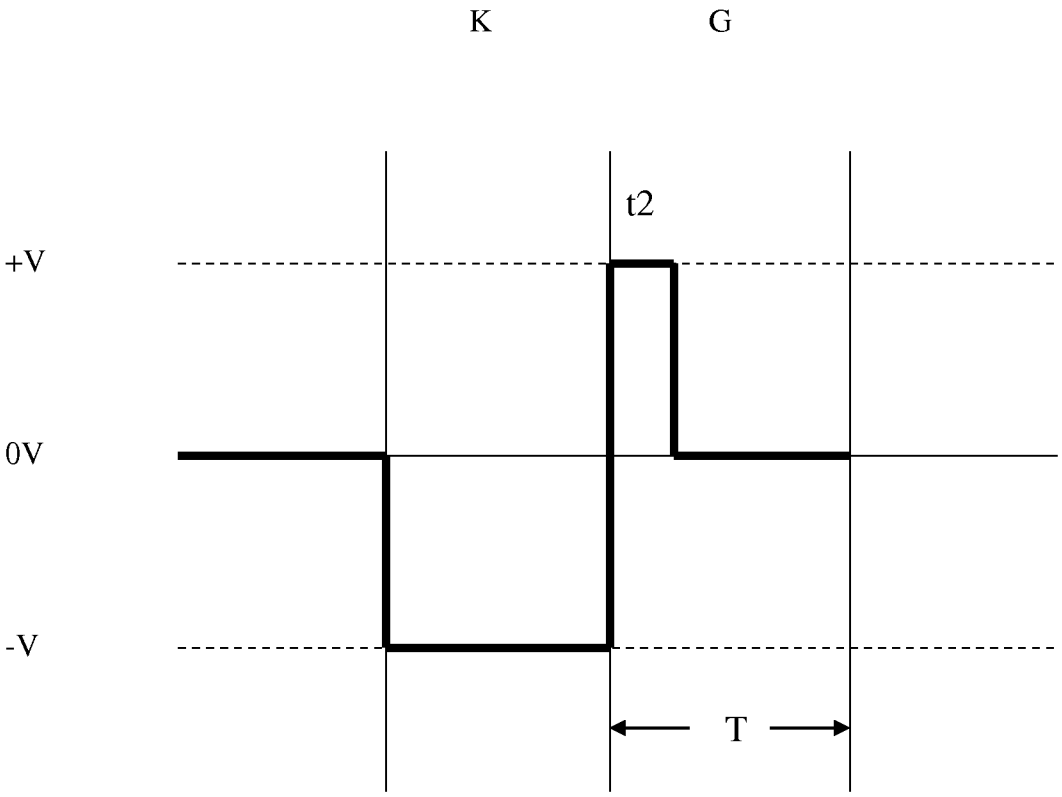
Figure 7b: KG Waveform

DRIVING SYSTEM FOR ELECTROPHORETIC DISPLAYS

CROSS REFERENCE TO RELATED APPLICATIONS

This application claims the benefit of priority under 35 U.S.C. §119(e) from U.S. Provisional Application Ser. No. 61/533,562 entitled "DRIVING SYSTEM FOR ELECTROPHORETIC DISPLAYS", filed Sep. 12, 2011, the entire contents of which are incorporated by this reference for all purposes as if fully set forth herein.

TECHNICAL FIELD

It is common to drive an electrophoretic display by using a lookup table which stores driving waveforms. The lookup table usually involves the use of two memories, one storing the information for a current image and the other storing the information for a new image (that is, the image to be driven to from the current image). The lookup table is then searched based on the current image information and the new image information for a particular pixel, to find an appropriate waveform for updating the pixel.

The memory space required for storing the images and the lookup table is relatively large. For example, for an electrophoretic display capable of displaying 16 different grey levels, there are two image memories and, on top of that, the lookup table would also require 256 entries to store the driving waveforms.

Certain approaches described in certain sections of this disclosure and identified as "background" or "prior approaches" are approaches that could be pursued, but not necessarily approaches that have been previously conceived or pursued. Therefore, unless otherwise indicated, it should not be assumed that any of the approaches that are so described actually qualify as prior art merely by virtue of identification as "background" or "prior approaches."

SUMMARY OF THE INVENTION

One aspect of the present invention is directed to a driving method for updating a pixel in a current image to a new image, which method comprises the following steps:

a) storing only one image in an image memory; and b) generating a look-up map when new image data are sent to a display controller and updating the image memory with the new image data.

The method may further comprise c) selecting driving voltage data, frame by frame, from sub-look-up tables, based on new image data and category identified by the look-up map; and d) sending the driving voltage data in step (c), frame by frame, to a display.

In one embodiment, the number of the sub-lookup tables do not exceed 50% of the number of grey levels of the images.

In one embodiment, the category of the waveform required to drive a pixel to its desired color state in the new image is determined based on the real time comparison of the current image and the new image.

In one embodiment, the images have 16 grey levels.

Another aspect of the present invention is directed to a driving system for an electrophoretic display, which system comprises a) only one image memory, b) a plurality of sub-lookup tables wherein the number of the lookup tables do not exceed 50% of the number of the grey levels and each sub-lookup table has a corresponding waveform selector, and c) a lookup map generator and a lookup map.

A further aspect of the present invention is directed to an electrophoretic display controller comprising: a display controller central processing unit (CPU) comprising a plurality of waveform selectors coupled to a category selector, and a lookup table map generator; a plurality of sub-lookup tables coupled to the display controller CPU; a first interface configured to couple to a host computer CPU; a second interface configured to couple to a display; a third interface configured to couple to an image memory; and a fourth interface configured to couple to a lookup table map.

Yet a further aspect of the present invention is directed to an electrophoretic display controller comprising: a lookup table map generator having a first connection configured to couple to an image memory to receive image data and a second connection configured to couple to a lookup table map; two or more sub lookup tables each having an input configured to receive a frame number and outputs coupled to respective waveform selectors; a category selector having a plurality of inputs coupled to the waveform selectors and to the lookup table map; and an interface configured to couple to a display.

The driving method and system of the present invention can reduce the memory space required for driving an electrophoretic display.

BRIEF DESCRIPTION OF THE DRAWINGS

FIGS. 7*a* and 7*b* are example driving waveforms which may be applied to the present invention.

DETAILED DESCRIPTION OF THE INVENTION

Figure 1:
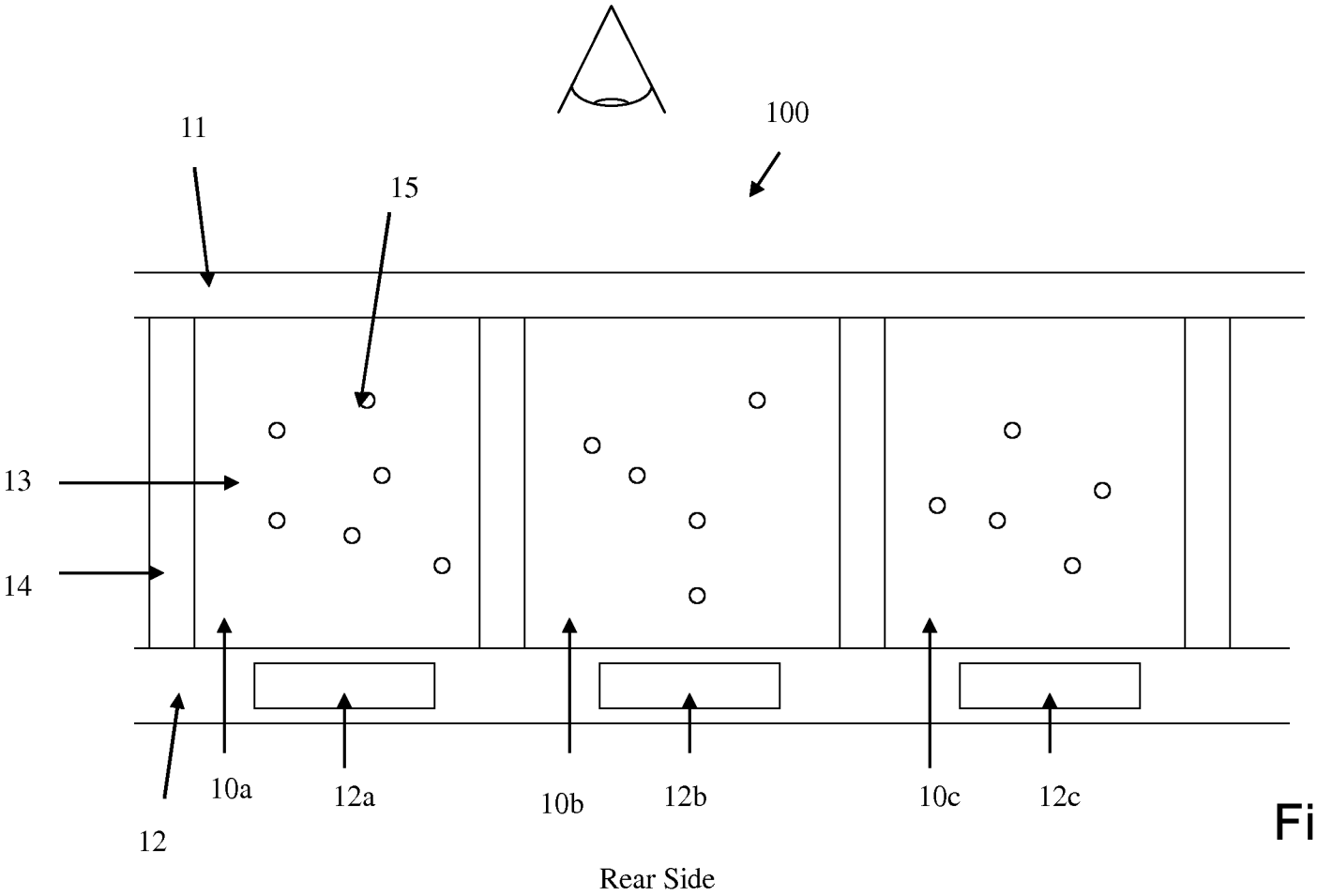
FIG. 1 depicts a typical electrophoretic display device.

FIG. 1 illustrates an electrophoretic display 100 which may be driven by the driving method presented herein. In FIG. 1, the electrophoretic display cells 10*a*, 10*b* and 10*c*, on the front viewing side indicated with a graphic eye, are provided with a common electrode 11 (which is usually transparent and therefore on the viewing side). On the opposing side (i.e., the rear side) of the electrophoretic display cells 10*a*, 10*b* and 10*c*, a substrate 12 includes discrete pixel electrodes 12*a*, 12*b* and 12*c*, respectively. Each of the pixel electrodes 12*a*, 12*b* and 12*c* defines an individual pixel of the electrophoretic display. Although the pixel electrodes are shown aligned with the display cells, in practice, a plurality of display cells may be associated with one discrete pixel.

It is also noted that the display device may be viewed from the rear side when the substrate 12 and the pixel electrodes are transparent.

An electrophoretic fluid 13 is filled in each of the electrophoretic display cells 10*a*, 10*b* and 10*c*. Each of the electrophoretic display cells 10*a*, 10*b* and 10*c* is surrounded by display cell walls 14.

The movement of the charged particles 15 in a display cell is determined by the voltage potential difference applied to the common electrode and the pixel electrode associated with the display cell in which the charged particles are filled.

As an example, the charged particles 15 may be positively charged so that they will be drawn to a pixel electrode or the common electrode, whichever is at an opposite voltage potential from that of charged particles. If the same polarity is applied to the pixel electrode and the common electrode in a display cell, the positively charged pigment particles will then be drawn to the electrode which has a lower voltage potential.

The charged particles 15 may be white. Also, as would be apparent to a person having ordinary skill in the art, the charged particles may be dark in color and are dispersed in an electrophoretic fluid 13 that is light in color to provide sufficient contrast to be visually discernable.

In another embodiment, the charged pigment particles 15 may be negatively charged.

In a further embodiment, the electrophoretic display fluid could also have a transparent or lightly colored solvent or solvent mixture with charged particles of two contrasting colors and carrying opposite charges dispersed therein. For example, there may be white pigment particles which are positively charged and black pigment particles which are negatively charged and the two types of pigment particles are dispersed in a clear solvent or solvent mixture.

The term "display cell" is intended to refer to a microcontainer which is individually filled with a display fluid. Examples of "display cell" include, but are not limited to, microcups, microcapsules, micro-channels, other partition-typed display cells and equivalents thereof. In the microcup type, the electrophoretic display cells 10*a*, 10*b* and 10*c* may be sealed with a top sealing layer. There may also be an adhesive layer between the electrophoretic display cells 10*a*, 10*b* and 10*c* and the common electrode 11.

In this application, the term "driving voltage" is used to refer to the voltage potential difference experienced by the charged particles in the area of a pixel. The driving voltage is the potential difference between the voltage applied to the common electrode and the voltage applied to the pixel electrode. As an example, in a single particle type system, positively charged white particles are dispersed in a black solvent. When zero voltage is applied to a common electrode and a voltage of +15V is applied to a pixel electrode, the "driving voltage" for the charged pigment particles in the area of the pixel would be +15V. In this case, the driving voltage would move the positively charged white particles to be near or at the common electrode and as a result, the white color is seen through the common electrode (i.e., the viewing side). Alternatively, when zero voltage is applied to a common electrode and a voltage of −15V is applied to a pixel electrode, the driving voltage in this case would be −15V and under such −15V driving voltage, the positively charged white particles would move to be at or near the pixel electrode, causing the color of the solvent (black) to be seen at the viewing side.

When a pixel is driven from one color state to another color state, a driving waveform is applied and the driving waveform would consist of a series of driving voltages.

The term "binary color system" refers to a color system which has two extreme color states (i.e., the first color and the second color) and a series of intermediate color states between the two extreme color states.

Figure 2:
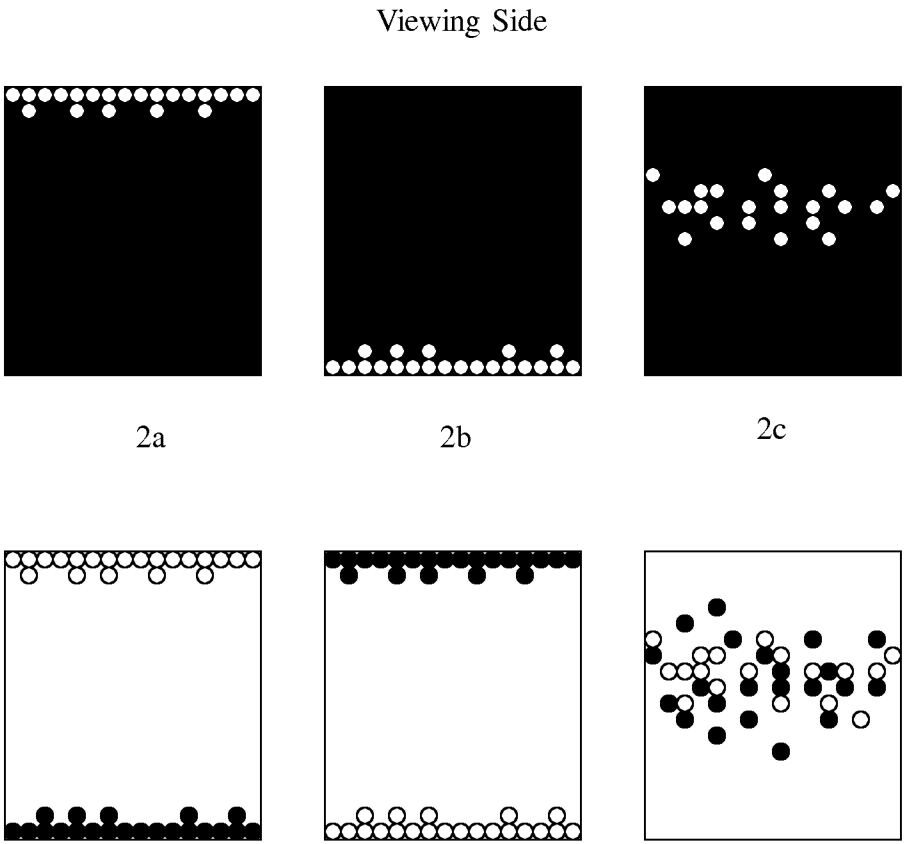
FIG. 2 illustrates an example of an electrophoretic display having a binary color system.

FIGS. 2*a*-2*c* show an example of a binary color system in which white particles are dispersed in a black-colored solvent.

In FIG. 2*a*, while the white particles are at the viewing side, the white color is seen.

In FIG. 2*b*, while the white particles are at the bottom of the display cell, the black color is seen.

In FIG. 2*c*, the white particles are scattered between the top and bottom of the display cell; an intermediate color is seen. In practice, the particles spread throughout the depth of the cell or are distributed with some at the top and some at the bottom. In this example, the color seen would be grey (i.e., an intermediate color).

FIGS. 2*d*-2*f* show an example of binary color system in which two types of particles, black and white, are dispersed in a clear and colorless solvent.

In FIG. 2*d*, while the white particles are at the viewing side, the white color is seen.

In FIG. 2*e*, while the black particles are at the viewing side, the black color is seen.

In FIG. 2*f*, the white and black particles are scattered between the top and bottom of the display cell; an intermediate color is seen. In practice, the two types of particles spread throughout the depth of the cell or are distributed with some at the top and some at the bottom. In this example, the color seen would be grey (i.e., an intermediate color).

It is also possible to have more than two types of pigment particles in a display fluid. The different types of pigment particles may carry opposite charges and/or charge of different levels of intensity.

While black and white colors are used in the application for illustration purpose, it is noted that the two colors can be any colors as long as they show sufficient visual contrast. Therefore the two colors in a binary color system may also be referred to as "a first color" and "a second color".

The intermediate color is a color between the first and second colors. The intermediate color has different degrees of intensity, on a scale between two extremes, i.e., the first and second colors. Using the grey color as an example, it may have a grey scale of 8, 16, 64, 256 or more.

In a grey scale of 16, grey level 0 (G0) may be the full black color and grey level 15 (G15) may be the full white color. Grey levels 1-14 (G1-G14) are grey colors ranging from dark to light.

Each image in a display device is formed of a large number of pixels and when driving from a current image to a new image, a driving waveform consisting of a series of driving voltages is applied to each pixel. For example, a pixel in the current image may be in the G5 color state and the same pixel in the new image is in the G10 color state, then when the current image is driven to the new image, that pixel is applied a driving waveform to be driven from G5 to G10.

Figure 3:
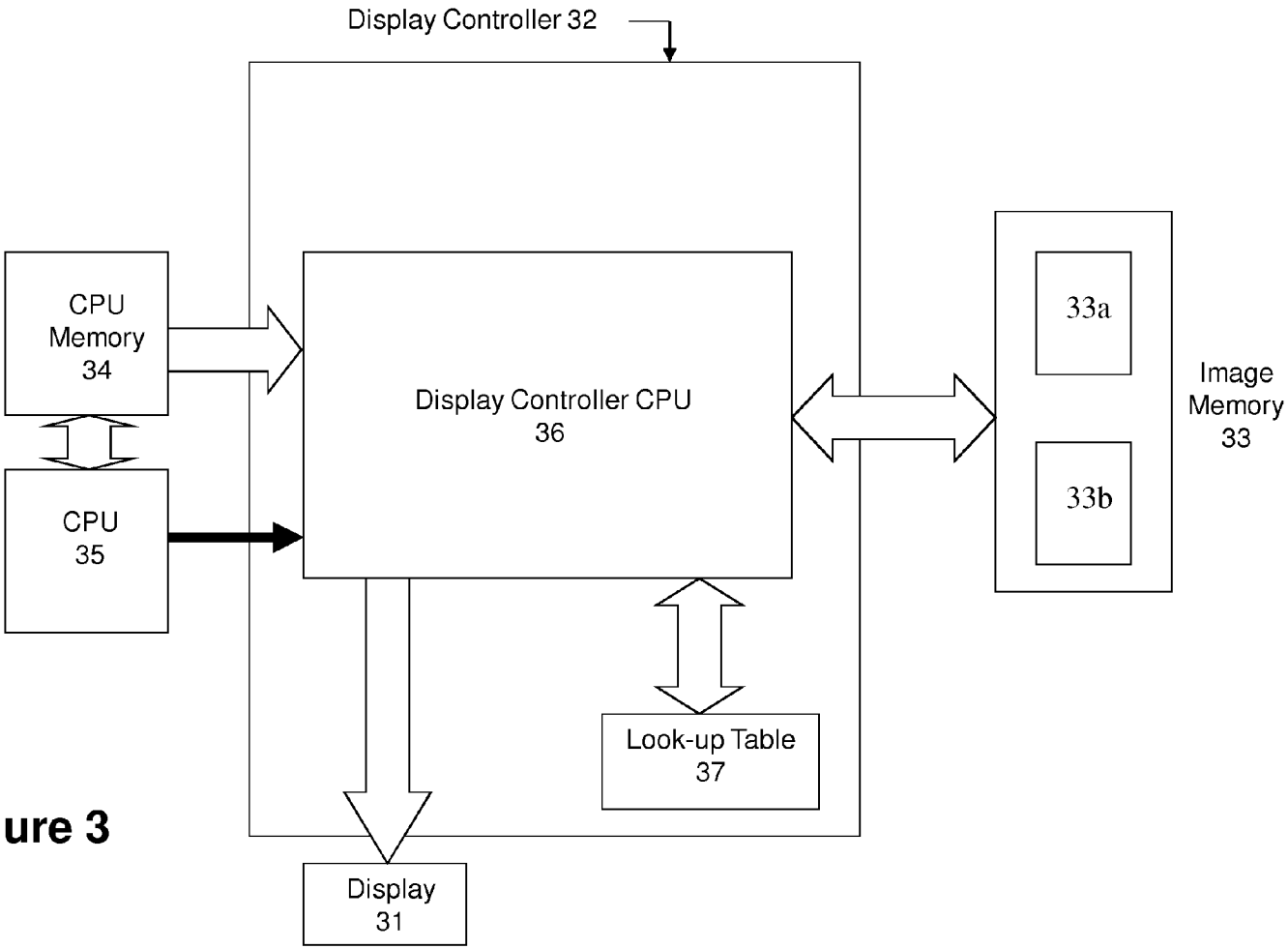
FIG. 3 represents a prior driving system.

FIG. 3 represents a diagram illustrating a prior driving system involving the use of a lookup table.

In the prior system as shown in the figure, the display controller 32 comprises a display controller CPU 36 and a lookup table 37.

When an image update is being carried out, the display controller CPU 36 accesses the current image data and the new image data from the image memory 33. Memory 33*a* denotes a memory for the current image data for all pixels while memory 33*b* denotes a memory for the new image data for the pixels.

When updating a pixel from a current image to a new image, the display controller CPU 36 consults the lookup table 37 to find an appropriate waveform for each pixel. More specifically, when driving from the current image to the new image, a proper driving waveform is selected from the lookup table for each pixel, depending on the color states in the two consecutive images of that pixel. For example, a pixel may be in the white state in the current image and in the G5 state in the new image, a waveform is chosen accordingly.

For a display device capable of having 16 levels of grayscale, there would be 256 (16×16) waveforms in the LUT to choose from.

The selected driving waveforms are sent to the display 31 to be applied to the pixels to drive the current image to the new image. The driving waveforms however are sent, frame by frame, to the display.

Throughout this application, the terms "current image" and "new image" are used to refer to the image currently being displayed and the next image to be displayed, respectively. In other words, the driving system updates the current image to the new image.

Figure 4:
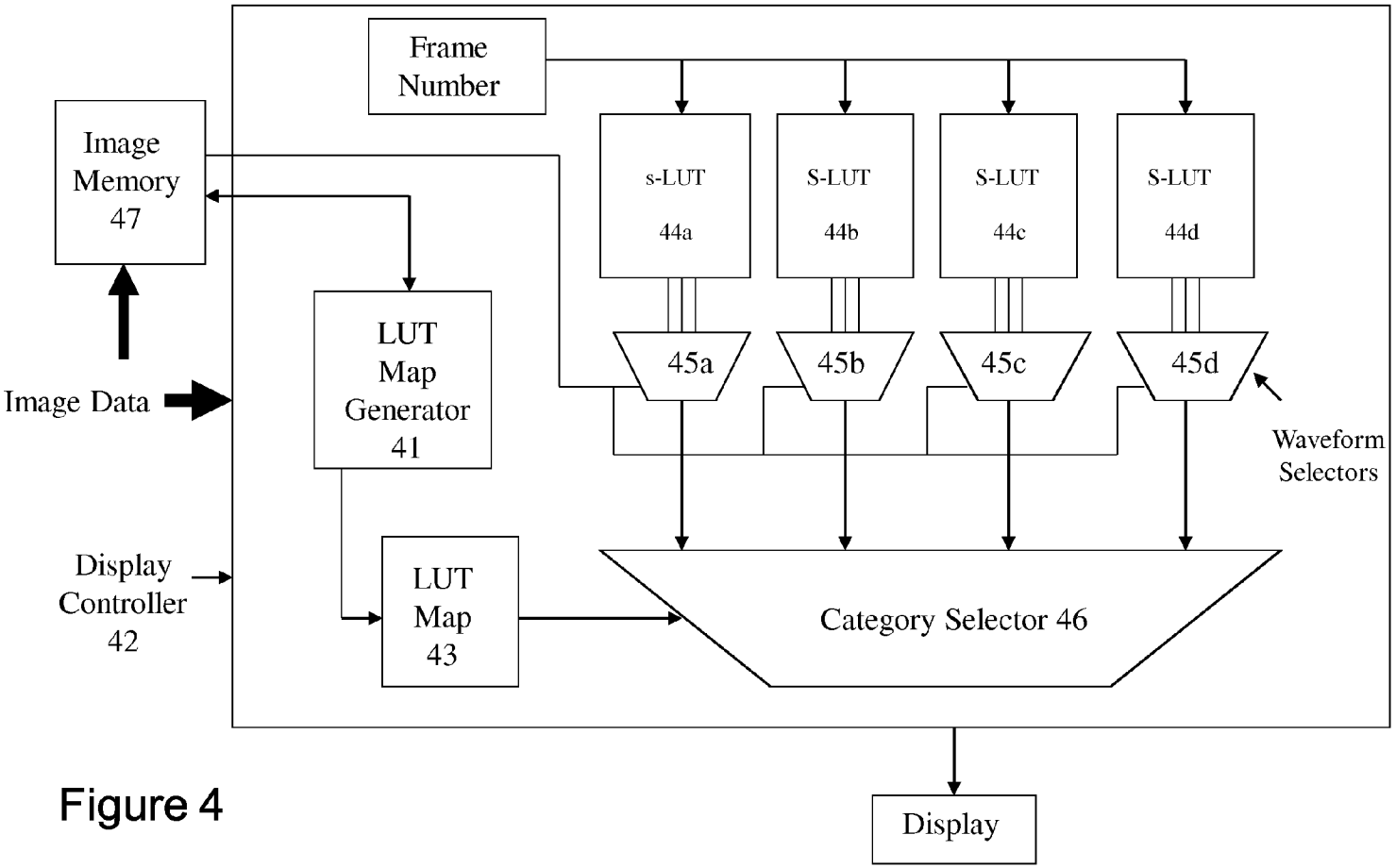
FIG. 4 illustrates the present invention.

FIG. 4 shows a diagram illustrating the present invention.

1) One Single Image Memory:

The first unique feature of the present invention is that only one image memory 47 is required. The single image memory only stores the image data for the new image.

For a display having 600×800 pixels and a grey scale of 16 levels (i.e., 4 bits), according to the present invention, the image memory 47 would only require a memory space of 240 k bytes (i.e., 600×800×4 bits).

By comparison, in the prior system, the required memory space is doubled (480 k bytes) because of the presence of two image memories, one for the current image and the other one for the new image.

2) Sub-Lookup Tables

The second unique feature of the present invention is that the lookup table is divided into sub-lookup tables (s-LUTs).

In the example as shown in FIG. 4, there are four s-LUTs, 44*a*-44*d*.

Each of the s-LUTs represents one category of driving waveforms and each category has waveforms for driving a pixel to each of the possible color states. Therefore, the number of the driving waveforms in each s-LUT may be the same as the number of the possible grey levels displayed by the driving system. For example, for a driving system of 16 grey levels, each s-LUT has 16 waveforms.

It is up to a system designer to decide how many s-LUTs there are in the driving system. But the rule is that the number of the s-LUTs cannot exceed 50% of the number of the grey levels. In a driving system of 16 grey levels, there cannot be more than 8 s-LUTs in the system.

It is also up to the system designer to decide how the waveforms are categorized.

In the context of the present application, a high grey level may be defined as any one of G8-G15 and a low grey level may be defined as any one of G0-G7.

However, no matter how the waveforms are divided into categories, all possible combinations of current and new color states for a pixel, are covered by the s-LUTs.

One example of s-LUTs is given in a section below.

In the prior system shown in FIG. 3, the entire lookup table 37 would require a memory space of about 16 k bytes (i.e., 16×16×256×2 bits), assuming that each driving waveform has 256 frames and each frame has 4 options (i.e., 2 bits) of an applied voltage. The 16×16 in the calculation represents the possible combinations of current (16) and new (16) color states for a pixel. The rest of the calculation is illustrated by FIG. 5.

Figure 5:
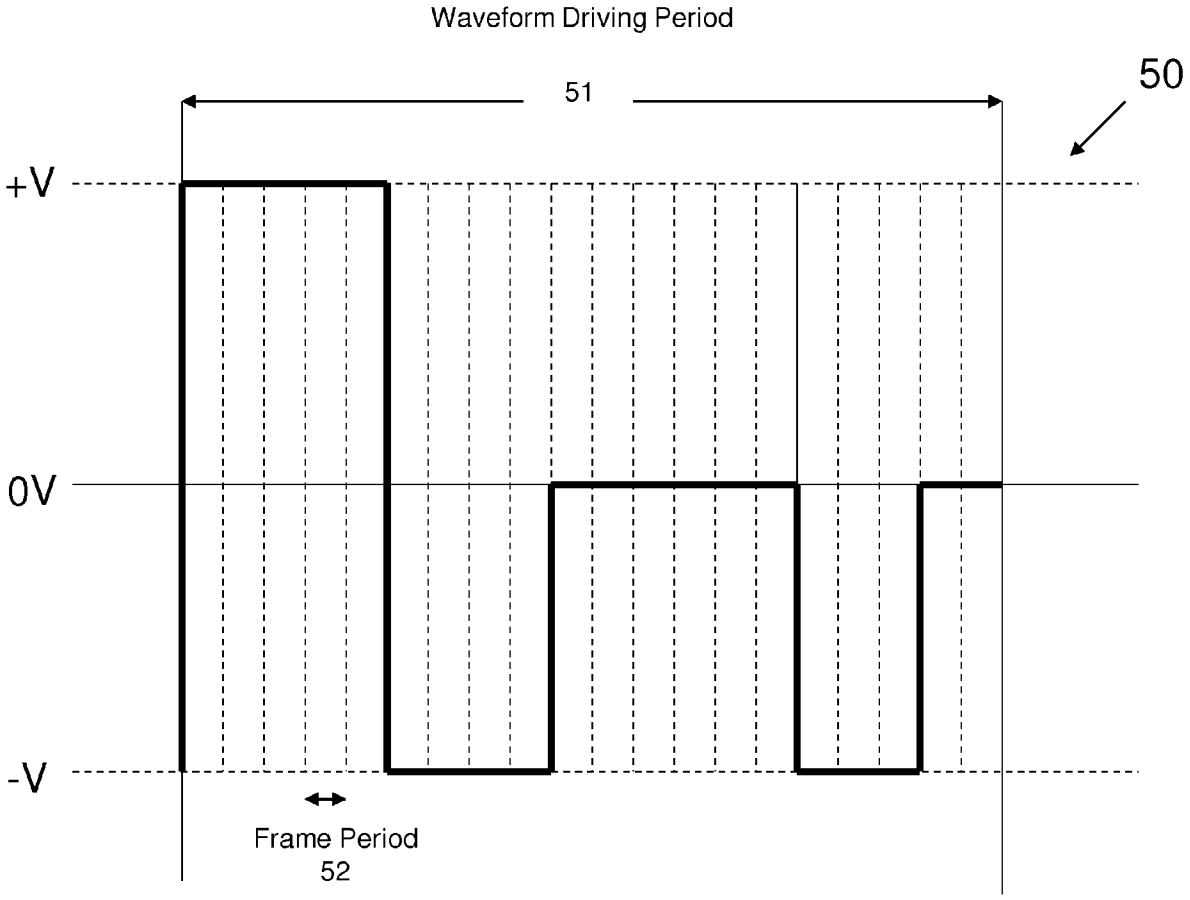
FIG. 5 shows an example waveform, for illustration purpose.

For illustration purpose, FIG. 5 shows an example waveform 50 for a single pixel. For the waveform, the vertical axis denotes the intensity and polarity of the applied voltage whereas the horizontal axis denotes the driving time. The waveform has a driving waveform period 51. There are many frames in the waveform and the length of a frame is referred to as a frame period or frame time 52.

A typical frame period ranges from 2 msec to 100 msec and there may be as many as 1000 frames in a waveform period. The length of the frame period in a waveform is determined by the TFT driving system design. The number of the frames in a waveform is determined by the time required to drive a pixel to its desired color state. In the calculation above, it is assumed that each waveform has 256 frames.

When driving an EPD on an active matrix backplane, as stated, it usually takes many frames for the image to be displayed. During a frame period, a particular voltage is applied to a pixel in order to update an image. For example, as shown in FIG. 5, during each frame period, there are at least three different voltage options available, i.e., +V, 0 or −V. The data in each s-LUT therefore needs at least 2 bits in size to store three possible options. A waveform consists of frames having different voltages to be applied.

Based on the information provided in the example as shown in FIG. 4, each s-LUT in the present invention would require a memory space of about 1 k bytes (i.e., 16×256×2 bits). The number 16 in this calculation represents the 16 waveforms in a s-LUT.

The total memory space required for the 4 s-LUTs therefore would be about 4 k bytes.

In utilizing the system of the present invention as shown in FIG. 4, several aspects of operation are involved:

Aspect 1:

At first, when a desired new image is sent to the display controller 42, the image memory 47 containing the current image (i.e., the previous "new" image) and the LUT map generator 41 perform a real time comparison of the current and new images, after which, the current image data are over-written by the new image data and the new image data are stored in the image memory 47. In other words, only the new image data are stored in the image memory 47 and the image memory 47 is constantly updated as the new images being fed into the display controller 42, pixel by pixel.

A lookup table map generator 41 determines the category of the waveform required to drive a pixel from its current color state to the new color state, based on the real time comparison of the current and new image data, pixel by pixel. Such information is then stored in the lookup table map 43. The lookup table map 43 has the category information for all pixels.

Aspect 2:

This aspect of the driving method is accomplished, frame by frame, starting from the first frame and ending in the last frame of a waveform. The frame that is being updated is fed into each of the s-LUTs 44*a*-44*d*.

After Aspect 1 where the transfer of the new image data to the image memory 47 is completed, an update command is sent to the display controller for updating the image.

The desired color state of the pixel in the new image is sent from the image memory 47 to the waveform selectors (45*a*-45*d*).

The waveform selectors 45*a*-45*d*, based on the desired color state of the pixel in the new image, select driving voltage data for the frame that is being updated, from the s-LUTs. For example, the waveform (among 16 waveforms) in s-LUT 44*a* which would drive the pixel to the desired color state is identified by the waveform selector 45*a* and the waveform selector 45*a* then sends the driving voltage data for the frame that is being updated in that waveform to the category selector 46.

The process as described for s-LUT 44*a* and the waveform selector 45*a* is similarly carried out with each pair of s-LUT (44*b*, 44*c* or 44*d*) and its corresponding waveform selector (45*b*-45*c*).

As a result of this aspect, there are four driving voltage data for the frame being updated which are sent to the category selector 46, each from one waveform selector.

Each of the driving voltage data sent to the category selector 46, from each waveform selector at this point, is based on only the new color state and therefore the data size is 2 bits.

Aspect 3:

The category selector 46 selects one driving voltage data from the multiple driving voltage data received from the waveform selectors 45*a*-45*d*, based on the category information from the lookup table map 43. Category selector 46 then sends the selected driving voltage data for the frame that is being updated, to the display (e.g., driver chip).

In operation, for each frame, the step of Aspect 2 always precedes the step of Aspect 3. For example, the steps of Aspects 2 and 3 are carried out for frame 1, which would be followed by the steps of Aspects 2 and 3 for frame 2, and so on.

Figure 6:
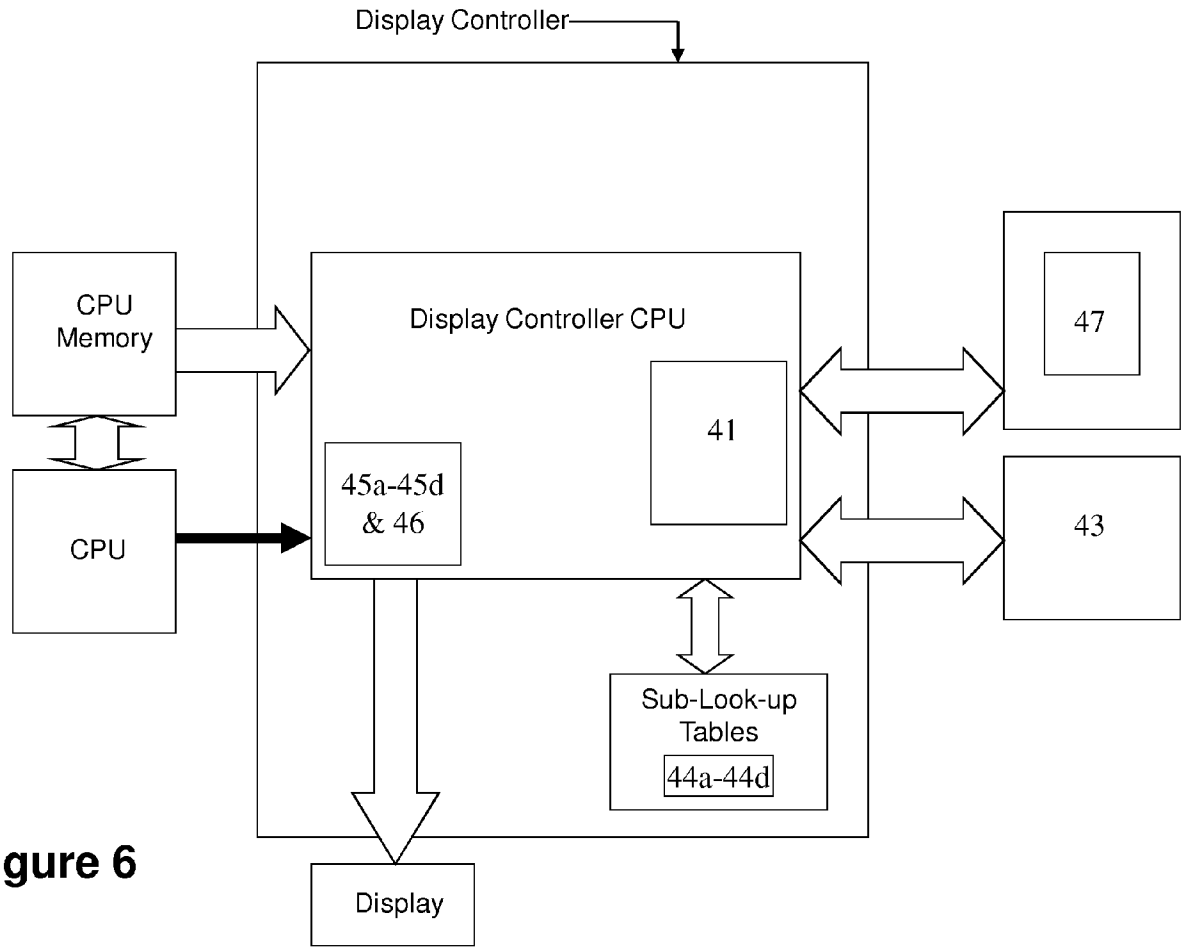
FIG. 6 represents a driving structure with the present invention incorporated therein.

FIG. 6 shows how the present invention may be incorporated into a display controller. The single image memory 47 for storing the new image data feeds the desired color state of a pixel into waveform selectors 4*a*-45*d*. The waveform selectors select and send multiple driving voltage data to the category selector 46. The waveform selectors and the s-LUTs are contained within the display controller.

In one embodiment, s-LUTs do not have to be within the display controller. For example, they may be in an external chip.

The memory space required for the lookup map 43 is about 120 k bytes (600×800×2 bits) for an image of 600×800 pixels. The calculation involves "2 bits" because there are 4 s-LUTs.

The following table summaries how the present invention may reduce the required memory space, as discussed in the application.

| Memory Space | Prior System | Invention |
|---|---|---|
| Image Memory | 480k | 240k |
| Lookup Table | 16k | 4k |
| Lookup Table Map | 0k | 120k |
| Total | 496k bytes | 364k bytes |

The driving method of the present invention for updating a pixel from a current image to a new image, therefore, may be summarized to comprise the following steps:

a) storing only one image in an image memory;

b) generating a look-up map when new image data are sent to a display controller and updating the image memory with the new image data;

c) selecting driving voltage data, frame by frame, from sub-look-up tables, based on new image data and category identified by the look-up map;

d) sending the driving voltage data in step (c), frame by frame, to a display.

Almost all of waveforms known to be able to drive electrophoretic displays may be used in the present invention.

For illustration purpose, a set of suitable waveforms is shown in FIGS. 7*a* & 7*b*.

The length of driving time, T, in the figures is assumed to be sufficiently long to drive a pixel to a full white or a full black state, regardless of the previous color state.

For illustration purpose, FIGS. 7*a* & 7*b* represent an electrophoretic fluid comprising positively charged white pigment particles dispersed in a black solvent.

For the WG waveform, if the time duration $t_1$ is 0, the pixel would remain in the white state. If the time duration $t_1$ is T, the pixel would be driven to the full black state. If the time duration $t_1$ is between 0 and T, the pixel would be in a grey state and the longer $t_1$ is, the darker the grey color.

For the KG waveform, if the time duration $t_2$ is 0, the pixel would remain in the black state. If the time duration $t_2$ is T, the pixel would be driven to the full white state. If the time duration $t_2$ is between 0 and T, the pixel would be in a grey state and the longer $t_1$ is, the lighter the grey color.

In other words, either of the two waveforms may be used in the present invention to drive a pixel to different desired color states, depending on the length of t1 in FIG. 7*a* or t2 in FIG. 7*b*.

EXAMPLE 1

Sub-Look-up Tables

There are three sub-look-up tables in this example.

Sub-LUT 1—for driving a pixel from a grey level (G0-G15) to the same grey level, e.g., G0→G0, G1→G1, G2→G2, etc.

Sub-LUT 2—for driving a pixel from a low grey level (G0-G7) to any of the 16 grey levels, e.g., G0→G1, G5→G6, G7→G13, etc.

Sub-LUT 3—for driving a pixel from a high grey level (G8-G15) to any of the 16 grey levels, e.g., G8→G1, G11→G6, G15→G14, etc.

In this case, a set of 16 waveforms would be designed for, and stored in, s-LUT 1. Each of the 16 waveforms would drive a pixel to G0, G1, . . . , G15, respectively, regardless of the starting color state (G0-G15).

Similarly there are also 16 waveforms in s-LUT 2 or s-LUT3.

While the present invention has been described with reference to the specific embodiments thereof, it should be understood by those skilled in the art that various changes may be made and equivalents may be substituted without departing from the true spirit and scope of the invention. In addition, many modifications may be made to adapt a particular situation, materials, compositions, processes, process step or steps, to the objective, spirit and scope of the present invention. All such modifications are intended to be within the scope of the claims appended hereto.

What is claimed is:

1. A driving system for an electrophoretic display, which system comprises a) only one image memory, b) a plurality of sub-lookup tables wherein the number of the sub-lookup tables does not exceed 50% of the number of grey levels that the display is capable of displaying, and each sub-lookup table has a corresponding waveform selector, c) a lookup map generator and a lookup map, and d) a category selector.

2. An electrophoretic display controller comprising:

only one image memory;

a lookup table map generator having a first connection configured to couple to the image memory to receive image data and a second connection configured to couple to a lookup table map;

two or more sub-lookup tables each having an input configured to receive a frame number and an output coupled to a corresponding waveform selector;

a category selector having a plurality of input coupled to the waveform selectors and to the lookup table map; and an interface configured to couple to a display.

3. A driving method for updating a pixel in a display from a current image to a new image, which method comprises the following steps:

a) providing a driving system which comprises (i) only one image memory, (ii) a lookup table map generator, (iii) a lookup table map, (iv) sub-lookup tables, (v) waveform selectors each corresponding to one of the sub-lookup tables, and (vi) a category selector;

b) storing only the new image in the image memory;

c) determining by the look-up map generator, category of a waveform required to drive the pixel from the current image to the new image by real time comparison of the current image and the new image, and storing the category of the waveform in the lookup table map;

d) selecting by the waveform selectors, driving data based on the waveform determined in step (c);

e) selecting by the category selector, one set of driving data resulted in step (d) based on the category stored in the lookup table map; and f) sending the selected driving data, frame by frame, to the display.

4. The method of claim 3, wherein the number of the sub-lookup tables does not exceed 50% of the number of grey levels of the display.

5. The method of claim 3, wherein the display is capable of displaying 16 grey levels.

* * * * *